US005224753A

United States Patent [19]

Fox

[11] Patent Number: 5,224,753

[45] Date of Patent: Jul. 6, 1993

[54] EASY TO ASSEMBLE COMBINATION TABLE AND BENCH

[76] Inventor: Clyde D. Fox, P.O. Box 105, Normanna, Tex. 78142

[21] Appl. No.: 933,802

[22] Filed: Aug. 24, 1992

[51] Int. Cl.[5] ..... A47B 39/00

[52] U.S. Cl. ..... 297/157; 297/440; 108/101

[58] Field of Search ..... 297/157, 159, 440, 442, 297/174; 108/101, 111, 155, 157, 153

[56] References Cited

U.S. PATENT DOCUMENTS

| | | | |
|---|---|---|---|
| 46,770 | 12/1914 | Haase | 297/440 X |
| D. 184,837 | 4/1959 | Sutfin | 297/157 X |
| 1,146,488 | 7/1915 | Finkelstein | 108/101 |
| 2,848,119 | 8/1958 | Fitser | 108/101 |
| 4,433,753 | 2/1984 | Watson | 297/442 X |
| 4,607,880 | 8/1986 | Gastebled | 297/157 |

FOREIGN PATENT DOCUMENTS

| | | | |
|---|---|---|---|
| 64758 | 12/1955 | France | 108/101 |

*Primary Examiner*—Laurie K. Cranmer
*Attorney, Agent, or Firm*—G. Turner Moller

[57] ABSTRACT

A combination table and bench includes a pair of substantially identical end supports made of bent round tubing. The end supports provide a series of horizontal planar slots. An elongate central slot receives a plurality of planks providing a table surface. A pair of lower slots receive planks to provide bench seating. The planks are sized to pass easily into the slots when the end supports are vertical. The end supports are inclined to bind the planks in position and thereby rigidify the combination table and bench.

11 Claims, 1 Drawing Sheet

EASY TO ASSEMBLE COMBINATION TABLE AND BENCH

This invention relates a combination table and bench that is easy to assemble and disassemble.

Picnic type tables, i.e. tables with attached benches, have been in use for many years. Typically, these tables are designed to stay outside in the weather because they are heavy and bulky. In addition, they are either nailed or bolted together and accordingly cannot be disassembled in any simple fashion. Simplified picnic type tables have been proposed in the prior art comprising a pair of metal end supports, one set of planking for the table and a set of bench planking on each side of the table. One such design is shown in U.S. Pat. No. D265,787 and analogous devices have been seen offered for sale. It is this type device that this invention most nearly relates.

Another class of disclosures relevant to this invention is in U.S Pat. Nos. 3,212,606; 3,809,183; 4,008,786 and 4,248,326. These devices comprise sawhorses, scaffolding or supports including a pair of metal end supports and a central plank. The end supports provide a slot of a size sufficient to receive the central plank when the support is in a vertical position. The end supports are then inclined to the vertical and bind the plank in the slot.

The combination table and bench of the prior art is heavy, bulky and difficult to assemble and disassemble. In contrast, the combination table and bench of this invention is easy to assemble and disassemble and has one outstanding advantage. Because the planking used for the table and bench surface can be ordinary lumber, the end supports and the planking may be sold separately. Preferably, the planking is 2×10" in 6 or 8' lengths although planking of other sizes is eminently suitable. This allows the consumer to purchase the planking at a very modest markup and finish the planking to his desires. This reduces the handling and inventory of the invention and provides a sturdy and desirable picnic type table at an outstanding price.

It is an object of this invention to provide an improved combination table and bench.

A further object of this invention is to provide an improved picnic type table comprising separable end supports and horizontal planar supports.

A more specific object of this invention is to provide an improved picnic type table which is easy to assemble and disassemble.

These and other objects of this invention will become more fully apparent as this description proceeds, reference being made to the accompanying drawings and appended claims.

IN THE DRAWINGS

Figure 1:
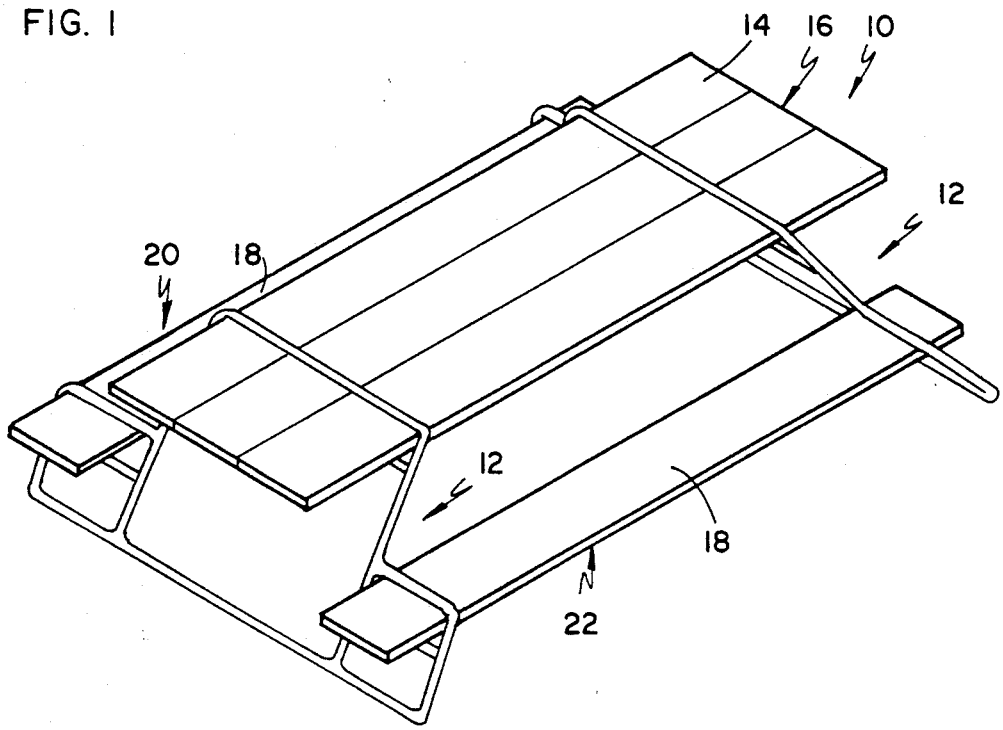
FIG. 1 is a isometric view of a combination table and bench of this invention.
Figure 2:
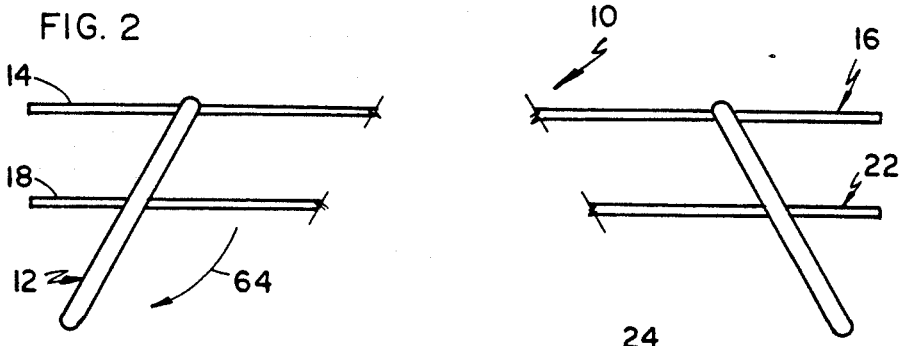
FIG. 2 is a side view of the table of FIG. 1.
Figure 3:
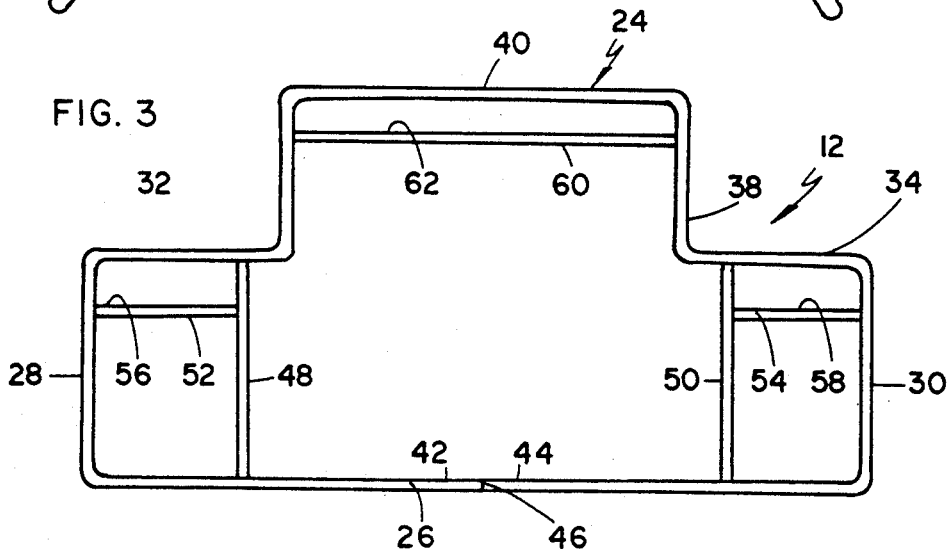
FIG. 3 is a front view of an end support of this invention.

Referring to FIGS. 1-3, a combination table and bench or picnic type table 10 comprises a pair of end supports 12, planar supports 14 comprising a table 16 and planar supports 18 providing a bench 20, 22 on each side of the table 16.

The end supports 12 are preferably, but not necessarily, identical for a variety of reasons. The supports 12 are desirably made of round tubing that can be bent using standard bending techniques and standard bending equipment. A suitable type tubing is $1\frac{3}{8}$" O.D. galvanized tubing, 1#/foot which is commercially available in twenty one foot lengths. The supports 12 comprise a peripheral frame 24 including a base 26 parallel to the underlying ground surface, first risers 28, 30 perpendicular to the base 26, horizontal sections 32, 34 parallel to and overlying the base 26, second risers 36, 38 and a horizontal section 40. Preferably, the frame 24 may be made of a single section of tubing bent on a desirable radius to provide the necessary risers and horizontal sections. The ends 42, 44 of the tubing may be at any desired position on the frame 24 and are welded together by a weldment 46.

The end supports 12 also comprise vertical supports 48, 50 welded between the horizontal supports 32, 34 and the base 26 thereby supporting and strengthening the horizontal supports 32, 34 to help carry the load imparted to the table 16 and benches 20, 22. Horizontal supports 52, 54 are welded between the risers 28, 30 and the vertical supports 48, 50. The supports 52, 54 are spaced from the supports 32, 34 to provide a slot 56, 58 therebetween. Similarly, a horizontal support 60 is welded between the risers 36, 38 so the supports 40, 60 provide a slot 62 elevated above the base 26 beyond the plane of the slots 56, 58. It will thus be seen that the slots 56, 58 provide for a pair of benches and the slot 62 provides for an elevated central table. The slots 56, 58, 60 are preferably the same vertical dimension so the planar supports 14, 18 may be of the same thickness.

When the end supports 12 are vertical or nearly so, the slots 56, 58, 60 are sufficiently large to easily receive the planar supports 14, 18. As the supports 12 are splayed outwardly to the inclined position shown best in FIG. 2, the effective height of the slots 56, 58, 60 decreases to thereby bind against the planar supports 14, 18 and make the combination table and bench 10 surprisingly sturdy. Those portions of the end supports 12 which have marred the galvanized coating during the manufacturing process may be retreated for corrosion resistance. The end supports 12 are painted after assembly to deter rusting or other types of deterioration. It will be seen that the end supports 12 are planar, i.e. all of the components lie in a common plane as shown best in FIG. 2 and thus are easily transported.

The planar supports 14, 18 are preferably standard sized lumber planks of a thickness to be received in the slots 56, 58, 60 and of a convenient width and length. As mentioned previously, a preferred thickness of the planks is a nominal 2". Although the planks 18 may be sufficiently wide so that only one is needed, it will be seen that two or more planks 18 may be used to essentially fill up the slots 56, 58. It will be apparent that the user may select any type lumber of any desired finish. Lumber attractively treated to withstand rain and the sun is particularly desirable although not essential.

Assembly and use of the combination table and bench 10 should be apparent. The planks 14, 18 are selected and may be finished as desired. With one of the end supports 12 more or less vertical, the planks 14, 18 are inserted into the slots 56, 58, 62. The planks 14, 18 are then inserted into the slots of the second end support. The end supports 12 are then inclined as shown by the arrows 64 in FIG. 2 to bind the planks 14, 18 in the slots 56, 58, 62 and thereby rigidify the combination table 10. Because the combination table and bench of this invention is so easily disassembled and can be stored in such a small space, it may be easily disassembled and stored during the winter or during non-use.

Although this invention has been disclosed and described in its preferred forms with a certain degree of particularity, it is understood that the present disclosure of the preferred forms is only by way of example and that numerous changes in the details of construction and operation and in the combination and arrangement of parts may be resorted to without departing from the spirit and scope of the invention as hereinafter claimed.

I claim:

1. A combination table and bench comprising a pair of facing end supports, each providing a base for supporting the bench on the ground, a first pair of horizontal members providing a first slot therebetween, at a first distance from the base, of a vertical dimension sized to receive an elongate planar support of predetermined thickness, second and third pairs of horizontal members on opposite sides of the first pair between the base and the first pair, the second and third pairs providing a second and a third slot, at a second distance from the distance less than the first base, of a vertical dimension sized to receive an elongate planar support of predetermined thickness, and a plurality of first elongate planar supports received in the first slot providing a table, at least one second elongate planar support received in the second slot providing a bench on a first side of the table, and at least one third elongate planar support received in the third slot providing a bench on a second side of the table, the end supports being inclined relative to the elongate planar supports and binding the elongate planar supports in the slots.

2. The combination of claim 1 wherein the elongate planar supports are lumber.

3. The combination of claim 1 wherein the end supports are symmetrical.

4. The combination of claim 3 wherein the end supports are identical.

5. The combination of claim 3 wherein the base comprises a length of tubing parallel to the ground and transverse to the planar supports.

6. The combination of claim 1 wherein the end supports each comprise a peripheral tubing frame comprising a first section parallel to the ground providing the base, first and second risers extending upwardly from the base, a first of the second pair of horizontal members connected to the first riser, parallel to and overlying the base, a first of the third pair of horizontal members connected to the second riser, parallel to and overlying the base, a third riser extending upwardly from the first of the second pair of horizontal members, a fourth riser extending upwardly from the first of the third pair of horizontal members, and a first of the first pair of horizontal support parallel to the base connected to the third and fourth risers.

7. The combination of claim 6 wherein the end supports further comprise a first vertical support connecting the base to the first of the second pair of horizontal supports and a second vertical support connecting the base to the first of the third pair of horizontal supports.

8. The combination of claim 7 wherein a second of the second pair of horizontal members extends between the first riser and the first vertical support and a second of the third pair of horizontal members extends between the second riser and the second vertical support.

9. The combination of claim 6 wherein the each end support is planar.

10. An end support for a combination table and bench, comprising a peripheral frame of tubular material including a first section parallel to the ground providing a base, first and second spaced apart risers extending upwardly from the base, first and second horizontal supports respectively connected to the first riser and second riser and extending parallel to and overlying the base, third and fourth risers extending upwardly from the first and second horizontal supports, a third horizontal support parallel to the base connected to the third and fourth risers, first and second vertical supports respectively between the first horizontal support and the base and the second horizontal support and the base, fourth and fifth horizontal supports respectively between the first and second vertical supports and the first and second risers, parallel to and spaced from the first and second horizontal supports to define therebetween first and second substantially identical slots of a size to receive spaced planar horizontal supports, and a sixth horizontal support between the third and fourth risers extending parallel to the third horizontal support to define therebetween a third slot of the same height as the first and second slots.

11. The combination of claim 10 wherein the third slot is substantially longer than the first and second slots in a dimension parallel to the base.

* * * * *